US006223819B1

(12) United States Patent
Heinonen

(10) Patent No.: US 6,223,819 B1
(45) Date of Patent: May 1, 2001

(54) WELLHEAD FOR PROVIDING STRUCTURE WHEN UTILIZING A WELL PUMPING SYSTEM

(75) Inventor: Robert L. Heinonen, Dallas, TX (US)

(73) Assignee: Double-E Inc., Dallas, TX (US)

( * ) Notice: Subject to any disclaimer, the term of this patent is extended or adjusted under 35 U.S.C. 154(b) by 0 days.

(21) Appl. No.: 09/351,664

(22) Filed: Jul. 13, 1999

(51) Int. Cl.[7] ..... E21B 19/00; E21B 33/03

(52) U.S. Cl. ..... 166/85.4; 166/75.14; 166/85.5; 166/86.1; 166/368

(58) Field of Search ..... 166/68, 75.14, 166/81.1, 84.1, 84.2, 84.4, 85.4, 85.5, 86.1, 176, 241.2, 368; 251/1.1, 1.2

(56) References Cited

U.S. PATENT DOCUMENTS 4,600,054 * 7/1986 Miller et al. ..... 166/75.1
4,762,473 8/1988 Tieben ..... 417/399
5,860,478 * 1/1999 Coutts et al. ..... 166/356
5,944,111 * 8/1999 Bridges ..... 166/348
6,000,469 * 12/1999 Bassinger ..... 166/84.1

* cited by examiner

*Primary Examiner*—David Bagnell
*Assistant Examiner*—Jennifer M Hawkins
(74) *Attorney, Agent, or Firm*—Jenkens & Gilchrist

(57) ABSTRACT

A wellhead for use with a surface mounted pumping unit operating a rod string extend to a downhole pump in a well. The wellhead includes a body having a bore for a rod string, a support rod assembly moveable across the bore for coupling with a rod string having a coupling flange to provide a rod string hanger and a releaseable lock operable with the rod string. The wellhead also comprises a hydraulic seal in the body around the bore to seal with a rod string through the bore. Blowout preventer rams in the body for closing off around the rod string through the body and closing off the bore through the body when no rod string is present. A securing structure at the opposite ends of the body secures the wellhead with a rod string operator above the wellhead and to secure the wellhead with a casing flange on a well.

7 Claims, 2 Drawing Sheets

WELLHEAD FOR PROVIDING STRUCTURE WHEN UTILIZING A WELL PUMPING SYSTEM

TECHNICAL FIELD

This invention relates to wellheads and more specifically wellheads for use with a well pumping system including a pump rod string between a surface mounted prime mover and a downhole pump.

BACKGROUND OF THE INVENTION

Wells, particularly oil wells, which penetrate subterranean formations in which the natural formation pressure is depleted to the level that the oil will not flow to the surface require that the oil be lifted to the surface by various means including pumping the oil from the producing formation to surface facilities.

One of the several available pumping units for raising and lowering a pump rod to drive a downhole pump includes a hydraulic fluid operated cylinder attached to the pump rod to raise and lower the rod to operate the pump. One particular hydraulic system utilizing a cylinder for driving the pump rod is the Tieben Pumping Unit manufactured and sold by Tieben Inc. West McArtor Road, Dodge City, Kans. 67801. The Tieben Pumping Unit is disclosed and claimed in U.S. Pat. No. 4,762,473 issued Aug. 9, 1988. The Tieben Pumping Unit may be mounted directly on the tubing pumping tee with the hydraulic cylinder shaft connected directly to the rod string which drives the downhole pump. The Tieben Pumping Unit may be mounter with a conventional stuffing box and blowout preventer or directly mounted eliminating the stuffing box. The direct mount arrangement results in the pump barrel seals serving the stuffing box function. With such a direct mount arrangement, when the hydraulic cylinder is serviced to change out the seals it is necessary to shut in the well and support the rod string during the servicing.

SUMMARY OF THE INVENTION

The improved wellhead of the present invention provides the structure required to supply the stuffing box and pump rod support functions when utilizing a well pumping system such as the Tieben Pumping Unit. In accordance with the invention, a wellhead is provided which includes a pump rod string hanger having a safety lock, a cylindrical rod seal for sealing around the rod string in the wellhead, and a blowout preventer having rams which may function as a master valve co-acting with the rod string or may seal on zero in the event of breakage of the rod string allowing the rod string to drop below the wellhead.

BRIEF DESCRIPTION OF THE DRAWINGS

For a more complete understanding of the present invention and the advantages thereof, reference is now made to the following description taken in conjunction with the accompanying drawings in which.

DETAILED DESCRIPTION PREFERRED EMBODIMENT OF THE WELLHEAD

Figure 1:
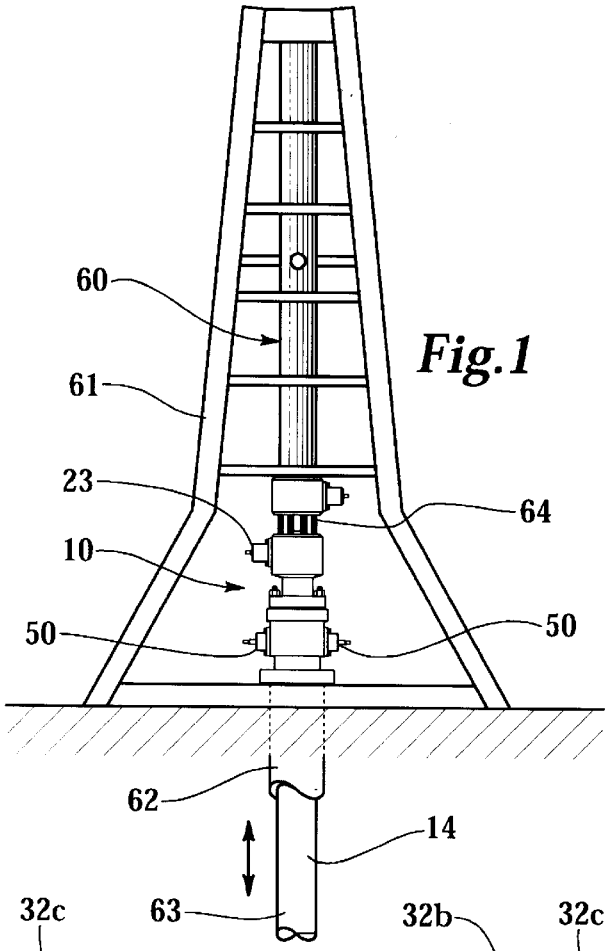
FIG. 1 is a schematic side view in elevation of a well pumping unit connected with a rod string extending into a well through a wellhead embodying the features of the invention.

Referring to FIGS. 2–6, a wellhead 10 embodying the features of the invention includes an upper body 11 and a lower body 12. The upper and lower bodies are secured together by nut-bolt assemblies 13 connected between and circumferentially arranged around the bodies. A ring gasket 14 fits in ring grooves in the lower face of the upper body and the upper face of the lower body to seal between the bodies. A bore 15 extends through the upper and lower bodies for a sucker rod or rod string 20 which extends through the wellhead to a downhole pump, not shown. The lower body has a flange 21 and stud bolts 22 are installed in the upper body for connecting the wellhead with a surface mounted rod string operator described hereinafter. The flange 21 has holes, not shown, for bolts to connect the wellhead to a well casing as described.

Figure 2:
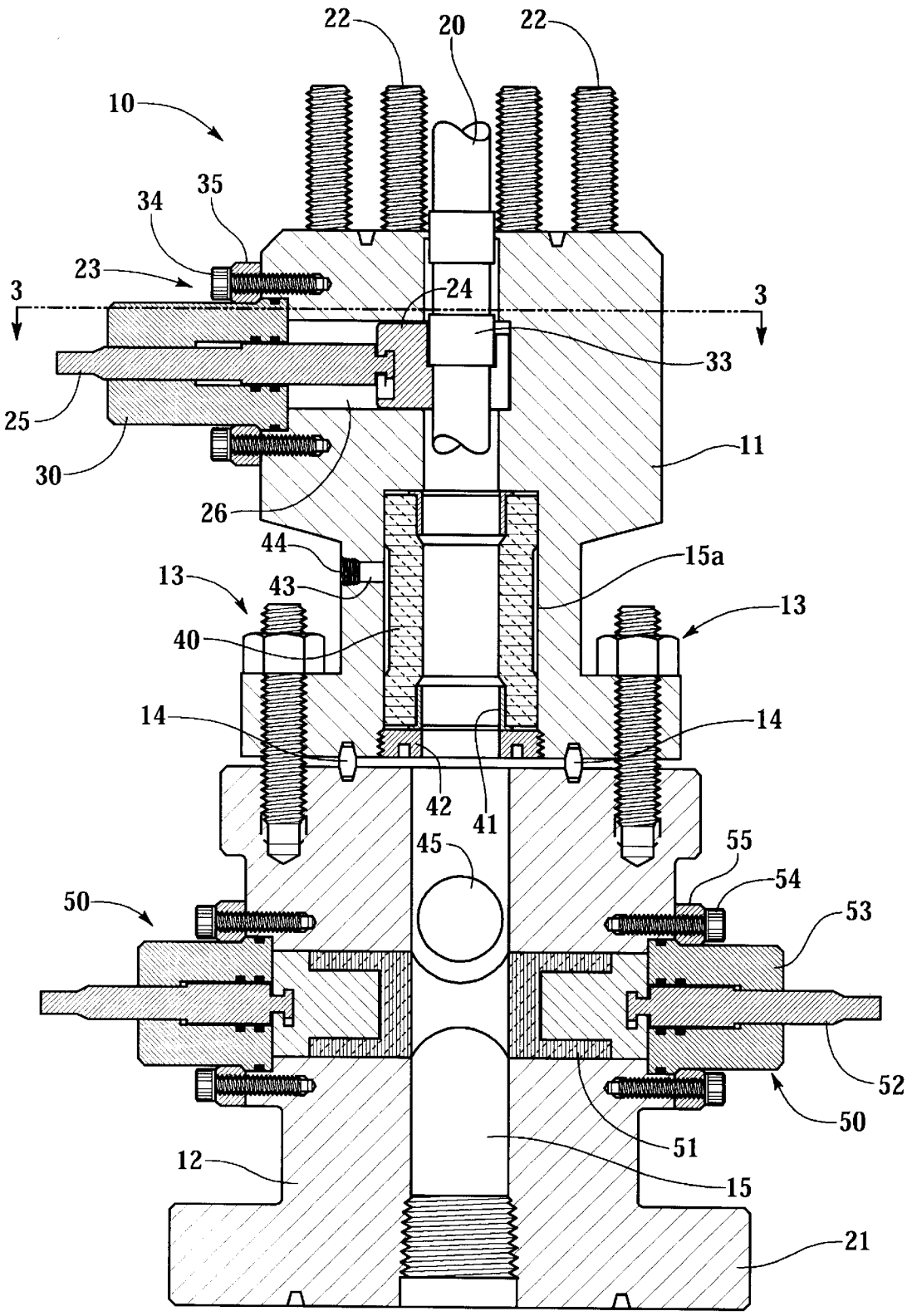
FIG. 2 is a longitudinal view in section of the wellhead of the invention showing a portion of and a coupling in the rod string through the wellhead.

Referring to FIGS. 2–6, a rod string hanger and safety lock assembly 23 is mounted in the upper body 11 for supporting the rod string 20 and to prevent the rod string from being accidentally released. As shown in FIG. 2, the assembly 23 is in a locked or engaged position for locking the rod string out of operation and supporting the rod string from the wellhead. The assembly 23 includes a support rod 24, shown in detail in FIGS. 4–6, an operator screw 25, and a support sleeve or nut 30.

Figure 3:
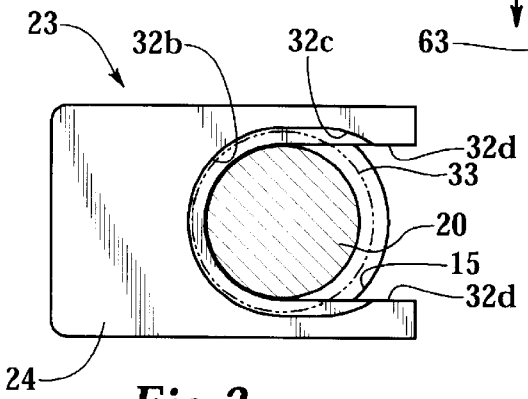
FIG. 3 is a view in section and elevation along the line 3—3 of FIG. 2 showing a top view in elevation of the rod string support rod interlocked with the rod string which is shown in section.
Figure 4:
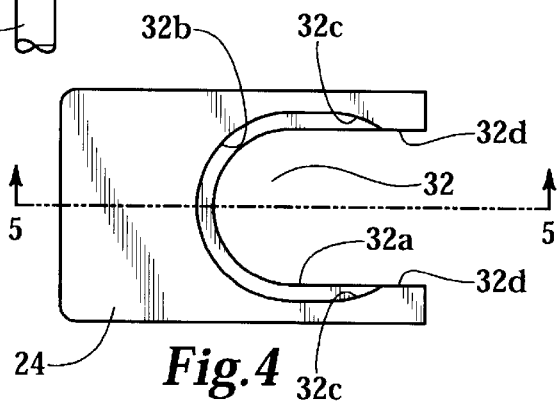
FIG. 4 is an enlarged top view of the rod string support rod.
Figure 6:
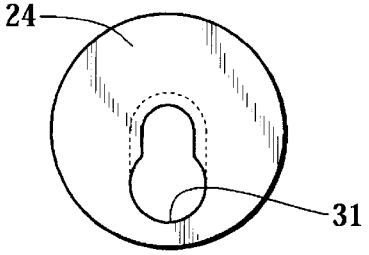
FIG. 6 is a left end view in elevation of the rod string support rod as seen FIGS. 4 and 5.
Figure 5:
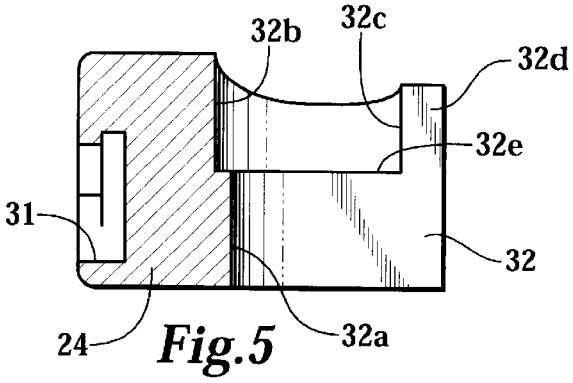
FIG. 5 is a side view in elevation and section along the line 5—5 of FIG. 4.

Referring to FIGS. 3–6, the rod string support rod 24 is a cylindrical member with a keyway 31 formed in the first or outward end of the rod for coupling the operator screw 25 with the rod. The second or inward end of the support rod is provided with an open ended vertical 2-step slot 32 having a lower slot portion 32*a* sized to fit around the rod string 20 below a coupling flange 33 on the rod string and an upper larger slot portion 32*b* which serves as a locking slot sized to receive the coupling flange 33 on the rod string for supporting the rod string. As shown in FIGS. 4 and 5, the upper slot portion 32*b* is formed with inward vertical curved surface portions 32*c* along opposite sides of the slot which curve inwardly toward each other to the diameter dimension of the lower slot portion 32*a* defining along the upper slot portion opposite side vertical locking flanges 32*d* which are spaced apart laterally the diameter of the rod string 20 below the rod string locking flange 33. The larger size or opening of the upper slot portion 32*b* relative to the lower slot portion 32*a* provides a support shoulder surface 32*e* in the support rod 24. It will be evident from FIGS. 2 and 3 which show the support rod in an engaged position with the coupling flang 33 on the rod string 20 that the support rod 24 can be moved laterally to the engaged position only when the rod string 20 is lifted to an elevation at which the coupling flange 33 is above the support rod upper slot portion 32*b*. When the support rod is moved inwardly by the operator screw 25 to the engaged position, the rod string 20 may be lowered with the flange 33 on the rod string moving downwardly entering the upper slot portion 32*b* to rest on the shoulder surface 2*e*. At such position of the coupling flange 33 in the upper slot portion 32, the curved slot surfaces 32*c* fit inwardly or wrap somewhat around the rod flange 33 so that the vertical lock flanges 32*d* prevent the support rod 24 from being moved laterally outwardly out of engagement with the rod string 20. It will be evident that the only way that the support rod 24 can be disengaged from the rod string 20 when the support rod 24 is in the position illustrated in FIGS. 2 and 3 is for the rod string 20 to be lifted upwardly to a position at which the coupling flange 33 is not in the upper slot portion 32*b* of the support rod 24. As illustrated in FIG. 2, the operator screw 25 fits through and is threadedly engaged with the sleeve 30 so that rotation of the operator screw 25 in the sleeve 30 moves the support rod 24 inwardly to engage the rod string 20 end outwardly to disengage the support rod 24 from the rod string 20. The support rod 24 slides inwardly and outwardly in a lateral cylindrical bore 26 formed in the upper body 11 of the wellhead. The bore 26 is a blind bore formed from the outside of the upper body portion perpendicular to and intersecting the vertical bore 15 through which the rod string 20 operates. The bore 26 has an enlarged outer end portion seen in FIG. 2 in which the inward end portion of the sleeve 30 is seated. As illustrated, the inward end portion of the sleeve 30 has an annular flange which fits in the enlarged outer end portion of the bore 26. The sleeve 30 is then locked in place by cap screws 34 and a lock ring 35 secured to the upper body 11 around the sleeve 30. Also, as illustrated in FIG. 2, ring seals or gaskets are installed around the sleeve 30 between the sleeve and body 11 and in the sleeve 30 around the operator screw 25 to prevent well fluids from leaking outwardly from the bore 15 in the upper body 11.

Referring to FIG. 2, the bore 15 through the upper body 11 is enlarged along a section 15*a* opening through the bottom of the body 11 for a tubular seal 40 which seals with the rod string to prevent well fluid flow upwardly around the rod string in the upper body 11. The seal 40 is a tubular element having metal support rings 41 along opposite end portions and held in place by a retainer nut 42 which screws into an internally threaded end portion of the enlarged bore 15*a* in the upper body 11. The seal 40 is a flexible sleeve made of a material such as a reinforced rubber or the like, sized to fit within the bore portion 15*a* around the rod string 20. The upper body 11 is provided with a port 43 leading into the bore portion 15*a* around the seal 40 for the injection of hydraulic fluid to collapse the seal 40 inwardly around the rod string to seal against leakage within the body around the rod string. A cap 44 is installed in the port 43 to close the port after the hydraulic pressure around the seal has been raised to the desired level.

The lower body 12 is provided with a flow tee outlet 45 leading to the bore 15 to permit production fluids to flow outwardly from the body from the bore 15 around the rod string 20. Below the outlet 45, two opposing blowout preventer ram assemblies 50 are installed in the lower body 12 to seal around the rod string 20 in the bore 15, or to close off on zero for shutting the bore 15 in the absence of a rod string through the bore. Each of the ram assemblies includes a ram 51 connected with an operator screw 52 threadedly engaged through a retainer sleeve 53 so that rotation of the screw 52 advances and retracts the ram 51 for opening and closing the bore 15 through the lower body. The retainer sleeve 53 is secured in operating position as shown by cap screws 54 which hold a retainer ring 55 engaging and holding the sleeve 53 in the body 12. The rams 51 may be any one of several commercially available ram designs, such as an all rubber steel reinforced cylindrical ram or a steel and rubber seal arrangement engageable with each other for sealing off the bore 15 when no rod string is present. Alternatively, the ram may be molded rubber or a combination of molded rubber and steel designed to seal with an exact rod string size. Each of the rams is operated by rotation of screws 52.

A variety of blowout preventer rams, as discussed above, are commercially available. For example, Double-E, Inc., 2039 Motor Street, Dallas, Tex. 75235, produces and sells the following rams: TYPE LP-DF and TYPE HP6-FF, both for sealing against each other when the rod string 20 is not between the rams; and TYPE LP and TYPE HP6, both of which will seal with and around the rod string 20.

The wellhead 10 may be used with a pumping unit drive system as shown in U.S. Pat. No. 4,762,473, a portion of which is also illustrated schematically in FIG. 1. A hydraulic cylinder 60 is mounted on a support such as a derrick 61 over a well having a casing 62 and production tubing 63. The wellhead 10 is secured by the flange 21 to the surface end of the casing 62 with the upper end of the tubing 63 being connected into the lower end of the bore 15 in the lower body 12. The rod string 20 is connected from the hydraulic cylinder through the wellhead extending to a pump, not shown, in the well at the producing formation for raising fluids from the formation in the tubing to the wellhead where the fluids flow outwardly through the tee outlet 45. During the installation of the wellhead brine is pumped down the well to a level sufficient to overcome the formation pressure thus allowing the tubing and rod string to be safely installed. The rod string 20 must be connected through the wellhead to permit the rod string coupling flange 33 to rise above the hanger and safety lock assembly 23 when the pumping unit is at the top of its stroke. During the installation of the wellhead the blowout preventer rams 51 and the support rod 24 of the lock assembly 23 are retracted outwardly from the bore 15 in the wellhead bodies. The rod string 20 above coupling flange 33 is attached to the polished rod extending from the bottom of hydraulic cylinder 60. A flanged spool 64 connects hydraulic cylinder 60 to the top of upper body 11 using stud bolts 22. The rod string is driven upwardly and downwardly by the hydraulic cylinder 60 to produce the well with fluids flowing upwardly in the tubing string 14 around the rod string and outwardly through the tee outlet 45. Ring joints in the flanged connections and seals within hydraulic cylinder 60, not shown, contain the well fluids above flow tee outlet 45.

When it is necessary to service the hydraulic cylinder 60, or remove the cylinder and related structure to another well, the particular features of the wellhead 10 of the invention permit a well to be shut in and, and if necessary, the rod string 20 to be suspended in the well from the wellhead. The rod string is raised to an elevation at which the coupling flange 33 is above the intersection of bore 26 in the upper body 11 with the vertical bore 15 through the body.

Referring to FIGS. 2–6, the operator screw 25 is rotated to drive the support rod 24 inwardly to the locked position shown in FIG. 2 at which the inward ends of the opposite sides of the rod 24 engage the inward end of the blind bore 26 so that the open inward end of the rod 24 is around the rod string 20 below the coupling flange 33. At this fully locked position of the support rod 24 the rod string below the flange 33 is within slot 32 with the lower cylindrical surface portion 32*a* of the slot engaging the rod string 20 below the flange 33 limiting the inward movement of the support rod 24. The rod string 20 is then lowered with the flange 33 entering the upper slot portion 32*b* of the rod 24. The lower edge of the flange 33 engages the support shoulder 32*e* of the support rod 24 at the lower end of the upper slot portion 32*b* so that the lower end of the flange 33 rests on the support shoulder 32*e* thereby suspending the rod string 20 in the well. At this inward position of the support rod 24 with the rod string flange 33 lowered into the support rod slot, the flange 33 is captured with in the slot 32 and the support rod 24 cannot be moved outwardly due to interference between the flange 33 and the vertical lock flanges 32*d* within the support rod 24 on opposite sides of the flange 33. The spacing between the lock flanges 32*d* is less than the diameter of the rod string flange 33 so that the support rod 24 cannot be moved to left as seen in FIG. 2 from the lock position illustrated. The only way that the support rod 24 can be disengaged from the rod string 20 and the rod flange 33 is to lift the rod string 20 upwardly until the flange 33 is above the support rod 24.

With the rod string 20 locked at a suspended position in the wellhead 10, hydraulic fluid is injected through port 43. Seal 40 seals within the upper wellhead body 11 around the rod string 20 thereby shutting the well in around the rod string within the wellhead. Additionally, a master valve function may be effected by the blowout preventer ram assemblies 50 if the rams 51 are configured to seal with the rod string 20. The rams 51 are moved into engagement with the rod string by rotation of the drive screws 52. Alternatively, the rams 51 may include seals designed to come together to fully close off the bore through the wellhead in the event that the rod string 20 breaks and falls below the wellhead leaving the bore 15 through the wellhead open. This is sometimes referred to in the industry as a "zero" shut off.

Thus, it will be seen that the wellhead 10 permits the servicing of the hydraulic cylinder 60, or the complete removal of the cylinder, leaving the well shut in whether the rod string 20 is suspended in the well, or if the rod string breaks and falls below the wellhead.

While the wellhead 10 of the invention has been illustrated as used in conjunction with a supported cylinder 60, it will be recognized that the wellhead is readily usable with a variety of pumping units some of which are portable, and thus, readily movable from well to well. If desired, the wellhead may be left on a well while the pumping unit is moved to another well.

Although a preferred embodiment of the invention as been illustrated in the accompanying drawings and described in the foregoing specification, the wellhead is capable of numerous rearrangements and modifications of parts and elements without departing from the spirit of the invention.

What is claimed is:

1. A wellhead for use with a surface mounted pumping unit operating a rod string extending to a downhole pump in a well comprising:

a body having a bore therethrough for the rod string;

a seal in the body around the bore to seal with the rod string in the bore; and a rod string hanger and safety lock connected in the body and releasably engageable with the rod string, where the rod string hanger and safety lock includes a support rod moveable across the bore of the wellhead body and configured to engage a coupling flange on the rod string to support the rod string, the support rod being restrained in a locked relationship with the rod string until the rod string is moved to remove the coupling flange from the support rod.

2. A wellhead in accordance with claim 1 wherein the support rod has a rod string and coupling flange recess having first recess portion sized to receive the rod string, a second larger recess portion sized to receive a coupling flange on the rod string, and a support surface between the first and second recess portions for engagement with a surface on the rod string coupling flange when the support rod is coupled with the rod string and rod string coupling flange, the support rod having locking flanges extending along opposite sides of the second recess portion, the locking flanges being spaced apart less than diameter of the support rod coupling flange so that when the support rod coupling flange is disposed in the second recess portion of the support rod the support rod is restrained against movement across the rod string to an uncoupled position.

3. A wellhead in accordance with claim 2 wherein the support rod is connected with an operating screw threaded through a mounting sleeve for moving the support rod between a rod string hanger and lock position and a release position.

4. A wellhead in accordance with claim 3 wherein the wellhead seal is operable by hydraulic pressure to force the seal into a sealing relationship with the rod string.

5. A wellhead in accordance with claim 4 including blowout preventer rams mounted in the wellhead body extendable into the bore through the wellhead body to perform a master valve function in the bore to shut off flow through the bore.

6. A wellhead in accordance with claim 5 wherein the blowout preventers include rams selected from the a class consisting of a ram designed close off on zero to a defined rod size, a ram design to close off around an exact rod size, and a ram design for a zero shutoff when no rod is present between the rams.

7. A wellhead for use with a surface mounted pumping unit operating a rod string extending to a downhole pump in a well comprising:

a wellhead body having a first upper body portion and a second lower body portion, the body having a vertical bore extending the length of the body for a rod string operating through the body, the body having a first securing means at the upper end thereof for connection of a rod string operator to the body and a second securing means at a lower end thereof for securing the body to a casing flange of a well;

means defining a blind bore formed in the upper body section extending transverse to and intersecting the bore through the body;

a rod string support rod in the blind bore of the upper body section moveable between a rod string hanger and lock position and a release position in the blind bore, the support rod having an open ended recess shaped to allow the support rod to move around the rod string the recess having a lower recess portion sized to fit around the rod string below a coupling flange and a larger upper recess portion sized to fit around the rod string coupling flange, the support rod having a flange support surface between a first recess portion and a second recess portion for engagement by a flange surface on the coupling flange of the rod string whereby the support rod functions as a hanger for the rod string when the support rod is coupled with the rod string, the support rod further having vertical flange surfaces on opposite sides of the upper recess portion extending from the end of the support rod to the recess portion side, locking flanges being spaced apart less than the diameter of the coupling flange on the rod string so that when the rod string coupling flange is lowered into the upper recess portion of the support rod the support rod is not disengageable from the rod string when moved transverse to the rod string;

an operating screw secured in the upper body section coupled with the support rod for moving the support rod between a rod string hanger and lock position and a release position;

a tubular hydraulically operable seal in the upper body section around the bore below the support rod to seal with a rod string through the body in the bore and a port in the upper body section leading to the hydraulic seal for hydraulic operation of the seal;

blowout preventer ram assemblies in the lower body section for closing off flow through the bore; and means defining a flow outlet from the bore through the lower body section above the blowout preventer.

* * * * *

UNITED STATES PATENT AND TRADEMARK OFFICE

CERTIFICATE OF CORRECTION

PATENT NO. : 6,223,819 B1
DATED : May 1, 2001
INVENTOR(S) : Robert L. Heinonen

It is certified that error appears in the above-identified patent and that said Letters Patent is hereby corrected as shown below:

Title page,
ABSTRACT,
Line 2, replace "extend" with -- extending --

Column 1,
Line 31, replace "mounter" with -- mounted --.

Column 2,
Line 57, replace "flang" with -- flange --
Line 65, replace "2e" with -- 32e --

Column 5,
Line 4, replace "with in" with -- within --

Column 6,
Line 26, delete "a"
Line 49, replace "string" with -- string, --

Signed and Sealed this

Twenty-sixth Day of February, 2002

*Attest:*

*Attesting Officer*

JAMES E. ROGAN
*Director of the United States Patent and Trademark Office*